US007325333B2

(12) United States Patent
Tadano et al.

(10) Patent No.: US 7,325,333 B2
(45) Date of Patent: Feb. 5, 2008

(54) HEAT PUMP DEVICE AND DRYING MACHINE

(75) Inventors: Masaya Tadano, Ota (JP); Tetsuya Masuda, Ota (JP); Takahiro Nakamura, Ota (JP); Masafumi Nishino, Kyoto (JP); Nobuhiro Asada, Kusatsu (JP); Mitsuru Naganawa, Joyo (JP)

(73) Assignees: Sanyo Electric Co., Ltd., Osaka (JP); Sanyo Electric Techno Clean Co., Ltd., Osaka (JP)

( * ) Notice: Subject to any disclaimer, the term of this patent is extended or adjusted under 35 U.S.C. 154(b) by 0 days.

(21) Appl. No.: 11/214,016

(22) Filed: Aug. 30, 2005

(65) Prior Publication Data

US 2006/0048404 A1 Mar. 9, 2006

(30) Foreign Application Priority Data

Sep. 7, 2004 (JP) ..... 2004-260010

(51) Int. Cl.
*F26B 11/02* (2006.01)
*F25B 30/00* (2006.01)

(52) U.S. Cl. ..... 34/604; 34/607; 34/72; 34/73; 34/77; 34/78; 34/86; 62/238.7

(58) Field of Classification Search ..... 34/604, 34/605, 607, 134, 72, 73, 77, 78, 86, 219; 62/238.6, 238, 238.7
See application file for complete search history.

(56) References Cited

U.S. PATENT DOCUMENTS 4,603,489 A * 8/1986 Goldberg ..... 34/77
5,906,104 A 5/1999 Schwartz et al.

(Continued)

FOREIGN PATENT DOCUMENTS

EP 1 162 419 A1 12/2001

(Continued)

OTHER PUBLICATIONS

Oct. 17, 2007 EP extended Search Report for EP Appln. No. 05018938.0-2301.

*Primary Examiner*—Jiping Lu
(74) *Attorney, Agent, or Firm*—McDermott Will & Emery LLP

(57) ABSTRACT

There are disclosed a heat pump device and a drying machine using the device in which abnormal water supplying into a water-cooling heat exchanger for use in water-cooling of a heat pump can be easily detected without disposing any water amount gauge particularly. The heat pump device comprises: a water-cooling heat exchanger 13 for taking heat of a refrigerant which enters a capillary tube 10; a water amount adjusting valve 15 for adjusting the amount of cooling water to be supplied to the water-cooling heat exchanger 13; a temperature sensor 25, 26, or 27 for detecting temperature of the cooling water in the water-cooling heat exchanger 13 or temperature of the refrigerant passed through the water-cooling heat exchanger; and a control unit 20 for controlling the water amount adjusting valve 15, and the control unit judges abnormal water supplying into the water-cooling heat exchanger 13 in accordance with the controlling state of the water amount adjusting valve 15 and a change of the temperature detected by the temperature sensor under the controlling state.

3 Claims, 5 Drawing Sheets

U.S. PATENT DOCUMENTS

| | | | | |
|---|---|---|---|---|
| 6,255,952 | B1 * | 7/2001 | Jang | 340/588 |
| 2002/0014085 | A1 | 2/2002 | Sakakibara | |
| 2005/0268625 | A1 | 12/2005 | Sienel | |

FOREIGN PATENT DOCUMENTS

| | | | |
|---|---|---|---|
| EP | 2003 265880 | A | 9/2003 |
| JP | 09 269154 | A | 10/1997 |
| JP | 11-99299 | A | 4/1999 |
| JP | 2003269813 | A * | 9/2003 |
| WO | WO 03/019085 | A1 | 3/2003 |

* cited by examiner

HEAT PUMP DEVICE AND DRYING MACHINE

BACKGROUND OF THE INVENTION

The present invention relates to a heat pump device comprising a water-cooling heat exchanger for taking heat of a refrigerant which enters expansion means, and a drying machine comprising the heat pump device.

There has heretofore been a drying machine in which an electric heater or a gas burning heater is used as a heat source. After heating outside air by the electric heater or the burning heater to form high-temperature air, the air is blown into a storage chamber in which a matter to be dried is stored to dry the matter to be dried in the storage chamber. Moreover, the high-temperature air in the storage chamber, which has dried the matter to be dried, is discharged to the outside.

However, in the drying machine using the electric heater or the gas burning heater, outside air containing moisture at low temperature outside the storage chamber is used in the high-temperature air to be fed into the storage chamber. Therefore, much time is required until the matter to be dried is dried. Therefore, energy consumption for drying the matter to be dried increases, and there has been a problem that energy costs such as charges for electricity and gas are soaring.

To solve the problem, a clothing drying machine has been developed which is constituted of a compressor, a heating coil, an expansion valve, and a cooling coil. A heat pump capable of circulating a heat exchange medium is utilized. The matter to be dried is dried by the high-temperature air heated by the heating coil. Moisture evaporated from the dried matter is condensed and removed from the air by the cooling coil, and the condensed water is discarded (see, e.g., Japanese Patent Application Laid-Open No. 11-99299).

However, especially, in the drying machine such as a dry cleaner using a solvent as a washing liquid, it is necessary to recover the solvent by lowering of refrigerant evaporation temperature in an evaporator at a predetermined temperature or less. Therefore, the refrigerant before expanding in the heat pump device is cooled. In this cooling of the refrigerant before expanding, a water-cooling heat exchanger is used. A city water piping is extended through this heat exchanger, and a water amount adjustment valve controls the amount of water passing through the city water piping. Therefore, there is a case where that scales are generated depending on quality of the city water circulated through the city water piping, and there is a fear that the water amount adjustment valve or the like is clogged with these scales.

To solve the problem, in a water circuit of a hot-water supplying device and the like provided with a conventional heat pump device, it is detected whether or not the water circuit is clogged by calculating of a hot-water supplying capacity of the device based on data of a flow rate sensor and refrigerant temperature sensors disposed before and after the gas cooler.

However, since the flow rate sensor is expensive, there is a problem that the cost of the whole system becomes high, and there has been a demand for development of a method for detecting clogging of the water circuit without using any flow rate sensor.

SUMMARY OF THE INVENTION

The present invention has been developed to solve the conventional technical problem, and an object thereof is to provide a heat pump device and a drying machine using the device in which abnormal water supplying into a water-cooling heat exchanger used for water-cooling of a heat pump can be detected easily without disposing any water amount gauge particularly.

A heat pump device of the present invention comprises: a heat pump comprising a refrigerant circuit including a compressor, a radiator, expansion means, an evaporator and the like. The heat pump device further comprises: a water-cooling heat exchanger for taking heat of a refrigerant which enters the expansion means; water amount adjusting means for adjusting the amount of cooling water to be supplied into the water-cooling heat exchanger; temperature detecting means for detecting temperature of the cooling water in the water-cooling heat exchanger or temperature of the refrigerant passed through the water-cooling heat exchanger; and control means for controlling the water amount adjusting means. The control means judges abnormal water supplying into the water-cooling heat exchanger in accordance with the controlling state of the water amount adjusting means and a change of the temperature detected by the temperature detecting means under the controlling state.

The control means judges a degree of rise of the temperature detected in a state in which the water supplying into the water-cooling heat exchanger is stopped by the water amount adjusting means, and judges such water supply stopping abnormality that the cooling water cannot be stopped in a case where the temperature rise degree is smaller than a defined value.

Moreover, the control means judges a degree of fall of the temperature in a state in which the water is supplied to the water-cooling heat exchanger by the water amount adjusting means, and judges water supplying abnormality such as generation of clogging in a case where the temperature fall degree is smaller than a defined value.

Therefore, since abnormality of a water route for use in cooling the refrigerant before expanding can be judged without disposing any water amount gauge particularly, it is possible to reduce the cost of whole system.

Moreover, in the heat pump device of the present invention, the control means performs a predetermined alarming operation in a case where it is judged that the abnormal water supplying into the water-cooling heat exchanger is caused in the above-described invention.

According to the present invention, the control means can inform the abnormality, and the abnormality can be coped with swiftly.

Furthermore, a drying machine of the present invention using the above-described heat pump device comprises a storage chamber which contains a matter to be dried, and air is circulated from the radiator of the heat pump to the evaporator of the heat pump through the storage chamber to thereby dry the matter to be dried in the storage chamber.

Therefore, the air for drying is heated by the radiator and cooled by the evaporator at the same time. The water-cooling heat exchanger can fulfill a function of balancing this heating with cooling. If there is the abnormal water supplying into the water-cooling heat exchanger at this point, the balance between the heating and the cooling fails by accumulated heat. However, according to the present invention, since the abnormal water supplying into the water-cooling heat exchanger can be detected easily, the abnormality can be coped with early.

DETAILED DESCRIPTION OF THE PREFERRED EMBODIMENT

Embodiments of the present invention will be described hereinafter in detail with reference to the drawings.

Figure 1:
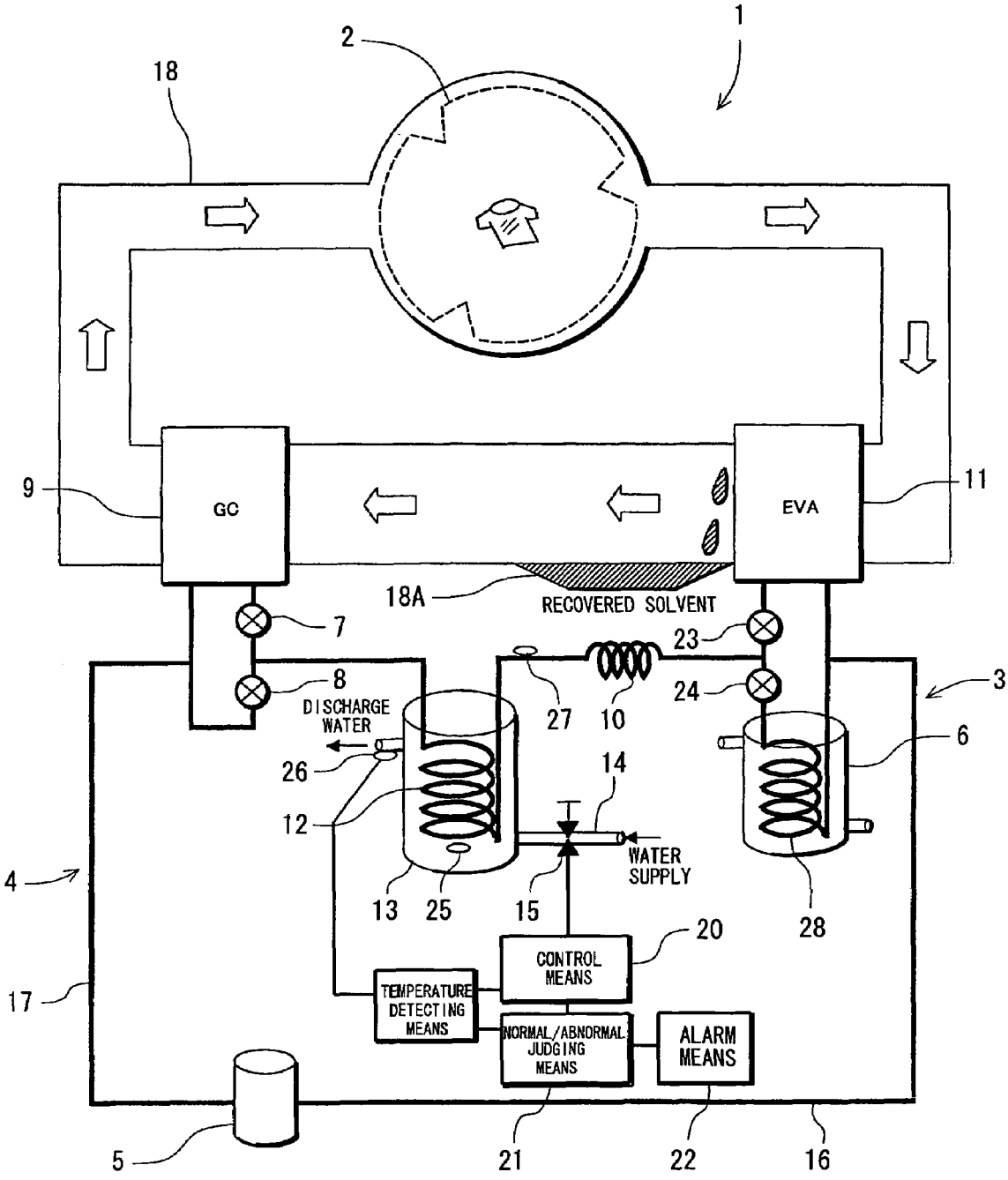
FIG. 1 is a schematic constitution diagram of a dry cleaner.

FIG. 1 shows a schematic constitution diagram of a dry cleaner 1 using, for example, a petroleum-based solvent as a washing liquid according to one embodiment of a drying machine to which a heat pump device 3 of the present invention is applied. In the respective figure, reference numeral 2 denotes a cylindrical drum including a large number of through holes formed in a peripheral wall, clothing (a matter to be dried) is washed by a washing liquid in a storage chamber 2A within this drum 2, and subsequently drying is also performed. This drum 2 is rotated by a drum motor (not shown), for example, at a speed of 30 to 50 rpm.

Moreover, this drum 2 is connected to a washing liquid circulation path (not shown) which supplies and discharges a washing liquid with respect to the storage chamber 2A, and this washing liquid circulation path is connected to a washing liquid tank, a washing liquid pump, a filter, a washing liquid cooling bath 6 and the like (not shown). When the washing liquid pump is operated, the washing liquid is supplied from the washing liquid tank to the drum 2, and the washing liquid in the drum 2 passes through the washing liquid pump and the filter, and is fed to the washing liquid cooling bath 6. Moreover, the washing liquid passed through the washing liquid cooling bath 6 repeats a cycle to return to the washing liquid tank. It is to be noted that in the present embodiment, eco-friendly silicon (solvent) is used as the washing liquid.

On the other hand, reference numeral 3 denotes the heat pump device 3 of the present invention, and the device comprises a refrigerant circuit 4. The refrigerant circuit 4 comprises a compressor 5, electromagnetic valves 7, 8, 23, and 24, a gas cooler 9 as a radiator, a capillary tube 10 as expansion means, an evaporator 11 and the like. Here, the compressor 5 for use in the present embodiment is an inner intermediate pressure type multi-staged compressing rotary compressor, and is provided with an electromotive element in a sealed container (not shown), and a first rotary compression element (first stage) and a second rotary compression element (second stage) driven by the electromotive element. Moreover, a low-pressure refrigerant is introduced from a refrigerant introducing tube 16 into the first rotary compression element of the compressor 5, and a high-temperature and high-pressure refrigerant compressed by second rotary compression element is discharged from a refrigerant discharge tube 17 to the outside of the compressor 5.

Moreover, the refrigerant discharge tube 17 of the compressor 5 is branched into two tubes, one tube is connected to the electromagnetic valve 7 via the gas cooler 9, and the other tube is connected to the electromagnetic valve 8. An outlet of the electromagnetic valve 7 is connected to a pipe 12, and the pipe 12 is connected to the capillary tube 10 through a water-cooling heat exchanger 13 as heat discharge means. An outlet of the electromagnetic valve 8 is connected to the pipe 12 (on an inlet side of the water-cooling heat exchanger 13) connected to the outlet of the electromagnetic valve 7.

Cooling water from a city water pipe 14 is circulated through the water-cooling heat exchanger 13 to cool the refrigerant which passes through the pipe 12. It is to be noted that reference numeral 15 denotes a water amount adjusting valve which controls the amount of water passed into the water-cooling heat exchanger 13, and comprises, for example, a step motor valve or the like. Moreover, in the water-cooling heat exchanger 13, there is disposed a heat exchanger temperature sensor 25 for detecting the temperature of the cooling water of the water-cooling heat exchanger 13. It is to be noted that the heat exchanger temperature sensor 25 may be a heat exchanger outlet temperature sensor 26 disposed in the outlet of the water-cooling heat exchanger 13. The pipe 12 passed through the water-cooling heat exchanger 13 is provided with a refrigerant temperature sensor 27 for detecting temperature of the refrigerant before expanding. On the other hand, the gas cooler 9 is disposed in such a manner as to exchange heat with an air circulation path 18 described later.

Furthermore, the capillary tube 10 on an outlet side is branched into two tubes, and the respective tubes are connected to the electromagnetic valves 23, 24. An outlet of the electromagnetic valve 23 is connected to the evaporator 11, and the evaporator 11 on the outlet side is connected to a suction side of the compressor 5 via the refrigerant introducing tube 16. An outlet of the electromagnetic valve 24 is connected to the refrigerant introducing tube 16, which extends out of the evaporator 11, via a pipe 28 disposed in the washing liquid cooling bath 6. The evaporator 11 is disposed in such a manner as to exchange the heat with the air circulation path 18.

Additionally, in the dry cleaner 1 of the present embodiment, the refrigerant circuit 4 is disposed in such a manner that the high-temperature and high-pressure refrigerant discharged from the compressor 5 exchanges the heat with the washing liquid cooling bath 6 in a radiator pipe (not shown). A predetermined amount of carbon dioxide ($CO_2$) is introduced as the refrigerant in the refrigerant circuit 4.

Moreover, in the present embodiment, a control unit 20 provided with normality/abnormality judging means 21 and alarming means 22 controls an operation of the compressor 5 and the water amount adjusting valve 15 depending on a discharged refrigerant pressure, a case temperature of the compressor 5, the heat exchanger temperature detected by the heat exchanger temperature sensor 25 or the heat exchanger outlet temperature sensor 26, or the temperature of the refrigerant before expanding detected by the refrigerant temperature sensor 27.

On the other hand, in the figure, the air circulation path 18 circulates air for drying in the drum 2, and constitutes an air path in which air returns from the drum 2 successively through a fan (not shown), the evaporator 11, and the gas cooler 9 back to the drum 2. Moreover, when the fan is operated, the air in the drum 2 is sucked to reach the evaporator 11. After the air exchanges the heat in the evaporator, thereafter exchanges the heat with the gas cooler 9, and is blown out into the drum 2 to repeat this cycle. It is to be noted that a trap 18A is constituted in the air circulation path 18 which extends out of the evaporator 11, and this trap 18A communicates with the inside of the washing liquid tank.

It is to be noted that the control unit 20 is control means for controlling the dry cleaner 1, and controls operations of the driving motor, the washing liquid pump, and the compressor 5, opening/closing of the electromagnetic valves 7, 8, 23, and 24, flow rate adjustment of the water amount adjusting valve 15 and the like. Furthermore, the control unit 20 controls an operation frequency of the compressor 5 in such a manner as to prevent a matter to be washed in the storage chamber 2A of the drum 2 from being discolored or damaged based on the discharged refrigerant pressure and the temperature of a case containing each apparatus. Furthermore, the passing water amount by the water amount adjusting valve 15 is controlled at a predetermined temperature based on an inlet refrigerant temperature of the capillary tube 10.

Figure 2:
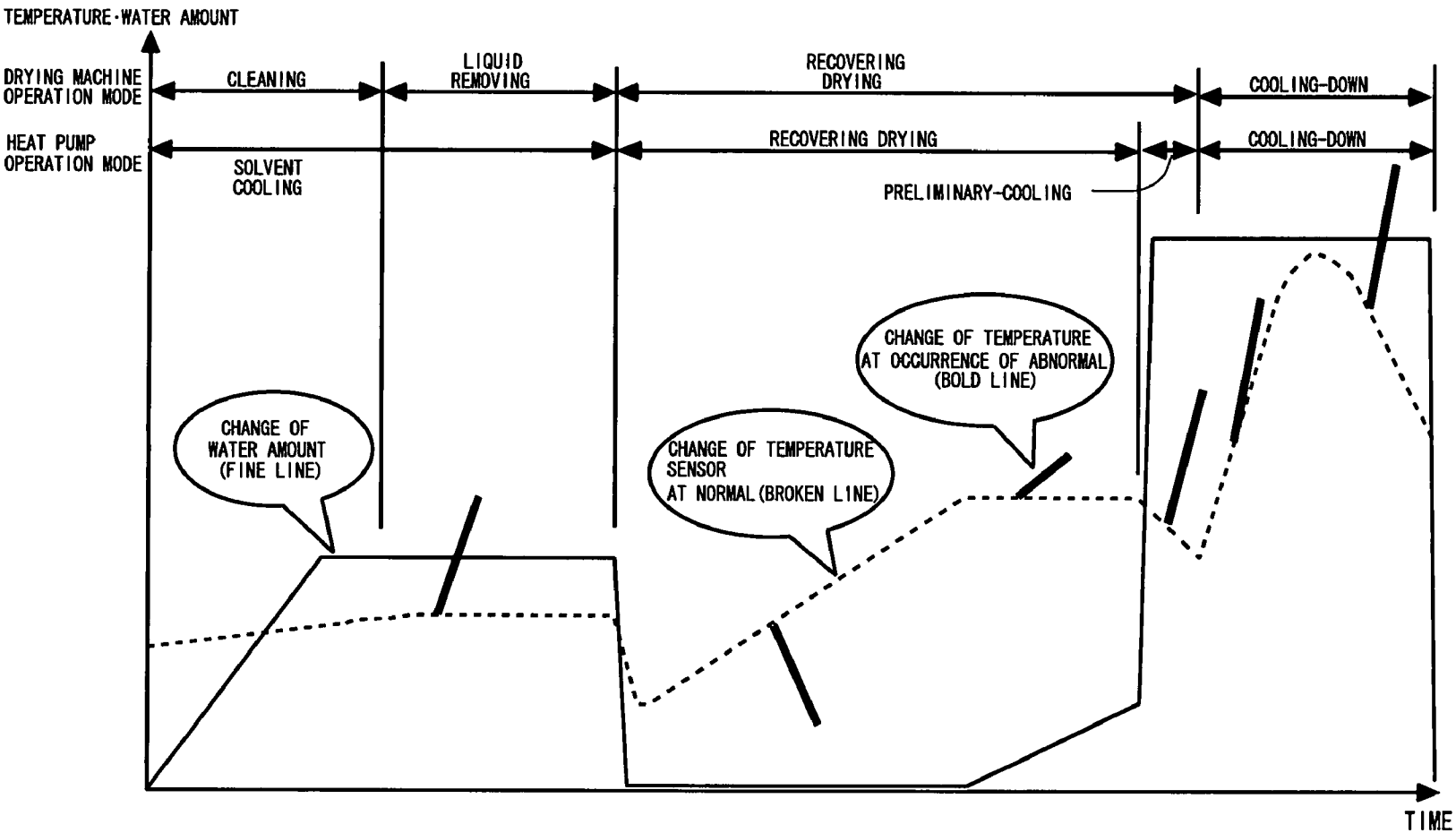
FIG. 2 is an explanatory view of an operation step, and the temperature of a heat exchanger and a changed of a water amount into the heat exchanger in the operation step of the dry cleaner of FIG. 1.

Next, an operation of the dry cleaner 1 of the present embodiment will be described in the above-described constitution with reference to FIG. 2. After the operation is started, the control unit 20 of the dry cleaner 1 successively executes operation steps of a cleaning step—liquid removing step-recovering and drying step-cooling-down step in accordance with a predetermined time program. Moreover, the heat pump device 3 is successively operated in modes of a solvent cooling mode-recovering and drying mode-preliminary cooling mode-cooling-down mode in accordance with proceeding of each operation step.

(1) Cleaning Step

First, in the cleaning step, the control unit 20 rotates (repeating forward and backward rotations) at the speed of 30 to 50 rpm, operates the washing liquid pump, and circulates the washing liquid in the drum 2 via the washing liquid circulation path. Clothing thrown into the drum 2 is washed by the rotation of the drum 2 and the washing liquid. The control unit 20 brings the heat pump device 3 into a solvent cooling mode from the start of this cleaning step. The unit executes a preliminary heating mode before this solvent cooling mode under winter conditions that outside air temperature is low. In the preliminary heating mode, the control unit 20 closes the electromagnetic valves 7, 8, 23, and 24 of the refrigerant circuit 4, and the unit opens an electromagnetic valve (not shown) to guide the refrigerant from the compressor 5 into the washing liquid cooling bath 6 as described above, and the electromagnetic valve 24.

Moreover, the unit operates the compressor 5 of the refrigerant circuit 4. When the compressor 5 is operated, a high-temperature and high-pressure carbon dioxide refrigerant compressed and brought into a supercritical state is discharged from the discharge side of the compressor 5 to the refrigerant discharge tube 17, and flows through the electromagnetic valve (not shown) into the radiator pipe (not shown) disposed in the washing liquid cooling bath 6. Thereafter, the high-temperature refrigerant radiates the heat to heat the washing liquid circulated in the washing liquid cooling bath 6. The refrigerant from which the heat has been discharged via the radiator pipe still retains its supercritical state, flows into the capillary tube 10, and liquefied in a pressure reducing process.

Furthermore, next the refrigerant flows into the pipe 28 disposed in the washing liquid cooling bath 6 via the electromagnetic valve 24, evaporates there, and takes the heat from the washing liquid cooling bath 6 to cool the bath. Thereafter, the refrigerant is sucked on the suction side of the compressor 5. The temperature of the compressor 5 rises by this operation. The heating by the radiator pipe is performed simultaneously with the cooling in the pipe 28 in the washing liquid cooling bath 6, and the temperature of the washing liquid circulated in the washing liquid cooling bath 6 gradually rises by the heat corresponding to an electric power supplied to the compressor 5 of the refrigerant circuit 4. Consequently, a cleaning effect of the clothing in the drum 2 is improved. Especially, early in the morning in winter, the temperature of the washing liquid can be raised to secure a cleaning ability quickly.

(2) Liquid Removing Step

On ending the cleaning step of the predetermined time program, the control unit 20 next shifts to a liquid removing step. In this liquid removing step, the washing liquid circulation path is switched to a path which bypasses the drum 2 to operate the washing liquid pump. Moreover, a liquid discharge valve (not shown) is opened to discharge the washing liquid from the drum 2. Moreover, the drum 2 is rotated (forwards), for example, at a high speed of 600 to 700 rpm to remove the liquid from the clothing.

When the temperature of the washing liquid cooling bath 6 rises at the predetermined temperature in the preliminary heating mode after shifting to this liquid removing step, the control unit 20 switches the heat pump device 3 from the preliminary heating mode to a solvent cooling mode.

Thereafter, in the solvent cooling mode, the control unit 20 closes an electromagnetic valve (not shown) of a circuit reaching the washing liquid cooling bath 6 of the refrigerant circuit 4, and the electromagnetic valves 7, 23, and opens the electromagnetic valves 8, 24. The water amount adjusting valve 15 is opened to feed the water from the city water pipe 14 to the water-cooling heat exchanger 13.

Moreover, when the compressor 5 of the refrigerant circuit 4 is operated, the high-temperature and high-pressure carbon dioxide refrigerant compressed and brought into the supercritical state is discharged from the discharge side of the compressor 5 to the refrigerant discharge tube 17, and flows into the pipe 12 through the electromagnetic valve 8. In a process in which the refrigerant flows through the pipe 12, the refrigerant is cooled by city water circulated through the water-cooling heat exchanger 13. The refrigerant retaining its supercritical state flows into the capillary tube 10, and is liquefied in the process in which the pressure is reduced.

Next, the refrigerant flows through the electromagnetic valve 24 into the pipe 28 disposed in such a manner as to exchange the heat with the washing liquid cooling bath 6, evaporates there, and takes the heat from the washing liquid cooling bath 6 to cool the bath. Thereafter, the refrigerant which has flown out of the pipe 28 is sucked on the suction side of the compressor 5. The control unit 20 controls the operation frequency of the compressor 5 in such a manner as to set the temperature of the refrigerant which enters the pipe 28 at the predetermined temperature in a case where the temperature of the washing liquid cooling bath 6 is not less than the predetermined temperature. When the temperature of the washing liquid cooling bath 6 is not more than the predetermined temperature, the operation frequency of the compressor 5 is lowered. When the temperature of the washing liquid cooling bath 6 further drops, the compressor 5 is stopped. The passing water amount into the water-cooling heat exchanger 13 is controlled in such a manner as to set the inlet refrigerant temperature of the capillary tube 10 at the predetermined temperature by the water amount adjusting valve 15.

Moreover, immediately (e.g., several minutes) before ending the liquid removing step, the control unit 20 closes the electromagnetic valve of the circuit directed to the washing liquid cooling bath 6 of the refrigerant circuit 4, and the electromagnetic valves 8, 24, and opens the electromagnetic valves 7, 23. The unit also opens the water amount adjusting valve 15 to pass water from the city water pipe 14 to the water-cooling heat exchanger 13.

Moreover, when the compressor 5 of the refrigerant circuit 4 is operated, the high-temperature and high-pressure carbon dioxide refrigerant compressed and brought into the supercritical state is discharged from the discharge side of the compressor 5 to the refrigerant discharge tube 17, and flows through into the gas cooler 9. The refrigerant radiates the heat there to heat the air in the air circulation path 18 around the gas cooler 9.

The refrigerant cooled there and retaining its supercritical state flows from the gas cooler 9 through the electromagnetic valve 7 into the pipe 12. The refrigerant exchanges the heat with the water-cooling heat exchanger 13, and further radiates the heat. Moreover, the refrigerant further cooled and retaining its supercritical state flows out of the pipe 12 into the capillary tube 10, and is liquefied in the process in which the pressure is reduced. Next, the refrigerant flows into the evaporator 11 through the electromagnetic valve 23, evaporates, and takes the heat from the air in the air circulation path 18 to cool the air. Thereafter, the refrigerant is sucked on the suction side of the compressor 5 via the refrigerant introducing tube 16. Furthermore, the control unit controls the passing water amount into the water-cooling heat exchanger 13 by the city water pipe 14 so that the inlet refrigerant temperature of the capillary tube 10 is set at the predetermined temperature.

(3) Recovering and Drying Step

On ending the liquid removing step, the control unit 20 next shifts to a recovering and drying step. In this recovering and drying step, the control unit 20 operates the fan (not shown), and rotates the drum 2. When the fan is operated, the air in the air circulation path 18 is successively fed to the gas cooler 9 via the evaporator 11 as described above. Since the high-temperature and high-pressure refrigerant of the refrigerant circuit 4 is circulated in the gas cooler 9 as described above, the air exchanges the heat, and is heated. After the temperature rises, the air is blown out into the drum 2. The washing liquid is evaporated from the clothing in the drum 2 by the high-temperature air.

The air which has evaporated the washing liquid in the drum 2 is sucked from the drum 2 by the fan, and fed to the evaporator 11 to repeat its cycle. Moreover, the control unit 20 brings the heat pump device 3 into a usually drying mode. It is to be noted that the control unit 20 once reduces the passing water amount into the water-cooling heat exchanger 13 by the water amount adjusting valve 15, or stops to promote a temperature rise of the circulated air in the air circulation path 18 described later, before shifting from the solvent cooling mode to the usual drying mode.

Moreover, in the subsequent usual drying mode, the control unit 20 closes the electromagnetic valve of the circuit directed to the washing liquid cooling bath 6 of the refrigerant circuit 4, and the electromagnetic valve 8, and opens the electromagnetic valve 7. The unit also opens the water amount adjusting valve 15 to pass the water from the city water pipe 14 into the water-cooling heat exchanger 13 as described above.

Furthermore, when the compressor 5 of the refrigerant circuit 4 is operated, the high-temperature and high-pressure carbon dioxide refrigerant compressed and brought into the supercritical state is discharged from the discharge side of the compressor 5 to the refrigerant discharge tube 17, and flows into the gas cooler 9. The refrigerant radiates the heat there to heat the circuit circulating in the air circulation path 18 around the gas cooler 9. Moreover, the heated air is discharged into the drum 2 as described above to dry the clothing.

On the other hand, the refrigerant is cooled there, and flows from the gas cooler 9 through the electromagnetic valve 7 into the pipe 12 while retaining the supercritical state. The refrigerant is water-cooled by the water-cooling heat exchanger 13 to lower the temperature. It is to be noted that a heat discharge amount in the water-cooling heat exchanger 13 is controlled in the same manner as in setting the inlet refrigerant temperature of the capillary tube 10 at the predetermined temperature. Thereafter, the refrigerant which has flown out of the pipe 12 flows into the capillary tube 10, and is liquefied in the process in which the pressure is reduced. Moreover, the refrigerant next flows through the electromagnetic valve 23 into the evaporator 11, evaporates there, and takes the heat from the air circulating in the air circulation path 18 around the evaporator 11 to cool the air. The washing liquid evaporated in the air solidifies on the surface of the evaporator 11 by the cooling. Moreover, the washing liquid liquefied on the surface of the evaporator 11 is recovered from the trap 18A into the washing liquid tank. When the clothing is heated, and the washing liquid is recovered in this manner, the clothing in the drum 2 is efficiently dried.

Thereafter, the refrigerant is sucked on the suction side of the compressor 5. The control unit 20 sets the compressor 5 to a maximum frequency within limits of the discharged refrigerant pressure and the case temperature. The unit also controls the passing water amount into the water-cooling heat exchanger 13 by the water amount adjusting valve 15 so that the inlet refrigerant temperature of the capillary tube 10 is set at the predetermined temperature.

After the usual drying mode is executed in accordance with the predetermined time program, the control unit 20 finally brings the heat pump device 3 into the preliminary cooling mode at the end of the drying mode. In this preliminary cooling mode, the control unit 20 operates the fan and the compressor 5 continuously from the previous-stage drying mode. Moreover, the unit fully opens the water amount adjusting valve 15, and passes the water from the city water pipe 14 into the water-cooling heat exchanger 13.

Moreover, when the compressor 5 of the refrigerant circuit 4 is operated, the high-temperature and high-pressure carbon dioxide refrigerant compressed and brought into the supercritical state is discharged from the discharge side of the compressor 5 into the refrigerant discharge tube 17, and flows into the pipe 12 through the electromagnetic valve 7 and the gas cooler 9. In the process in which the refrigerant passes through the gas cooler 9, the refrigerant is cooled by the air circulating through the air circulation path 18. Further in the process in which the refrigerant passes through the pipe 12, the refrigerant is cooled by the city water circulated in the water-cooling heat exchanger 13, discards the discharged heat, flows into the capillary tube 10 while retaining the supercritical state, and is liquefied in the process in which the pressure is reduced.

In this case, since the passing water amount into the water-cooling heat exchanger 13 is increased to the maximum amount in the preliminary cooling mode, the heat accumulated in the heat pump device 3 can be effectively discarded.

Next, the refrigerant flows into the evaporator 11, and takes the heat from the air fed from the air circulation path 18 into the evaporator 11 to cool the air. Thereafter, the refrigerant is sucked on the suction side of the compressor 5.

Moreover, the control unit 20 monitors either of the temperature of the refrigerant circuit 4 and that of the air circulation path 18. When the temperature is not more than the predetermined temperature, the unit shifts from the preliminary cooling mode to a cooling-down mode. It is to be noted that the shifting from the preliminary cooling mode to the cooling-down mode may be performed in accordance with the time program.

Furthermore, in the cooling-down mode, the control unit 20 continuously operates the fan, closes the electromagnetic valve (not shown) for guiding the refrigerant from the compressor 5 of the refrigerant circuit 4 to the washing liquid cooling bath 6, and the electromagnetic valves 7, 24, and opens the electromagnetic valves 8, 23. The unit also opens the water amount adjusting valve 15 to pass the water from the city water pipe 14 into the water-cooling heat exchanger 13 as described above.

Moreover, when the compressor 5 of the refrigerant circuit 4 is operated, the high-temperature and high-pressure carbon dioxide refrigerant compressed and brought into the supercritical state is discharged from the discharge side of the compressor 5 into the refrigerant discharge tube 17, and flows into the pipe 12 through the electromagnetic valve 8. In the process in which the refrigerant passes through the pipe 12, the refrigerant is cooled by the city water circulated in the water-cooling heat exchanger 13, discards the discharged heat, flows into the capillary tube 10 while retaining the supercritical state, and is liquefied in the process in which the pressure is reduced. When the refrigerant is cooled in the water-cooling heat exchanger 13, the heat accumulated in the heat pump device 3 is discarded, and an air cooling ability can be improved.

Moreover, the refrigerant next passes through the electromagnetic valve 23, flows into the evaporator 11, and takes the heat from the air fed from the air circulation path 18 into the evaporator 11 to cool the air. Thereafter, the refrigerant is sucked on the suction side of the compressor 5. The control unit 20 sets the compressor 5 to the maximum frequency within the limits of the discharged refrigerant pressure and the case temperature. The unit also controls a valve open degree of the water amount adjusting valve 15 so that the inlet refrigerant temperature of the evaporator 11 is set at the predetermined temperature.

The air circulated in the air circulation path 18 exchanges the heat with the evaporator 11, and is cooled. On the other hand, since any refrigerant does not flow into the gas cooler 9, there is not any heating ability. Accordingly, the temperature of the air circulated in the air circulation path 18 drops, and the temperature of the clothing in the drum 2 is lowered. Moreover, after executing this cooling-down mode in accordance with the predetermined time program, the control unit 20 stops its operation.

As described above, in the dry cleaner 1 (drying unit) using the heat pump device 3 as in the present embodiment, the heating of the air for drying by the gas cooler 9 is performed simultaneously with the cooling by the evaporator 11 in the usual drying mode. The water-cooling heat exchanger 13 fulfills a function of balancing the heating with the cooling. Therefore, when abnormal water supplying into the water-cooling heat exchanger 13 occurs, the heating cannot be balanced with the cooling, and therefore there is caused a disadvantage that the heat is accumulated.

Figure 3:
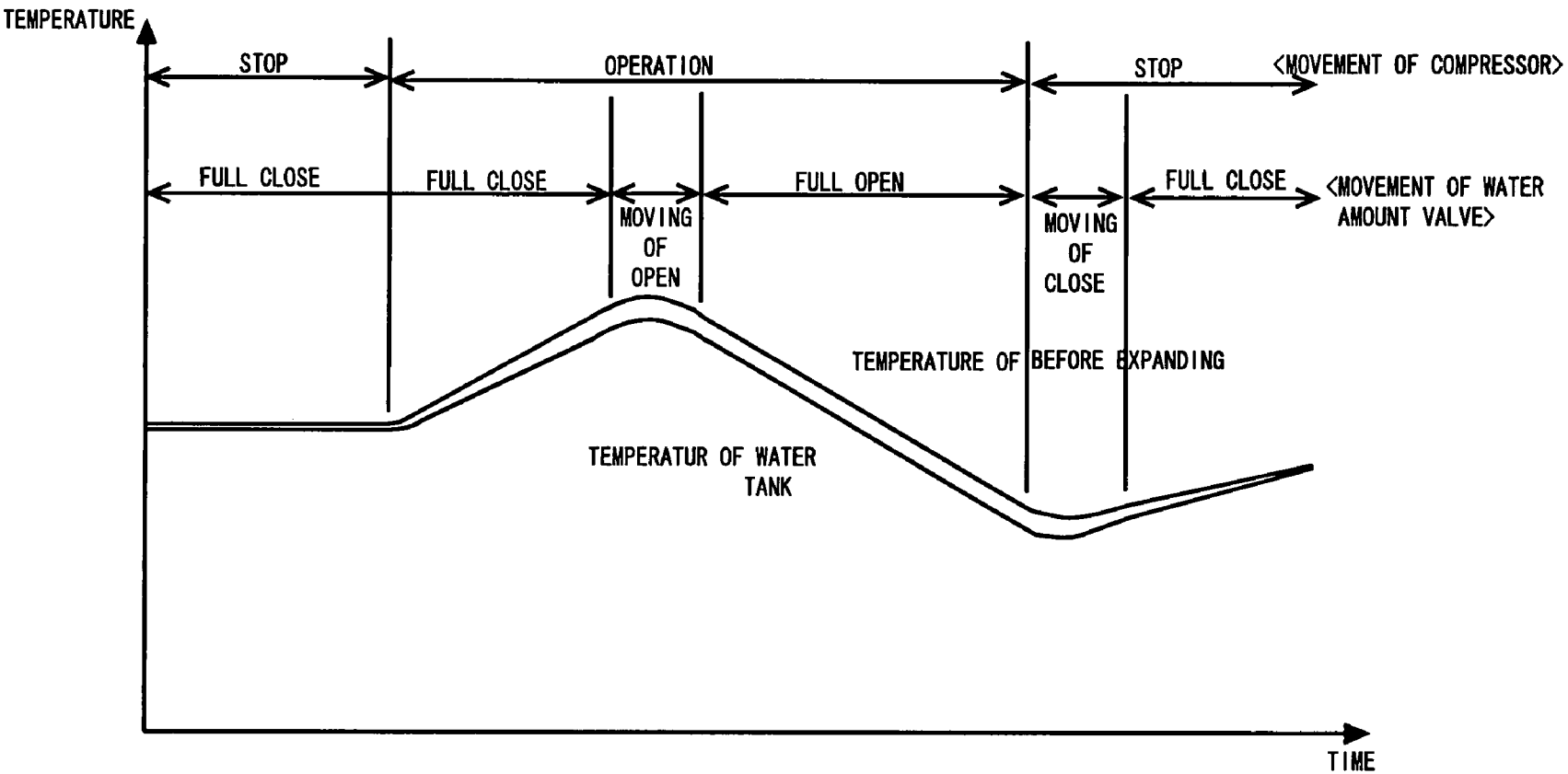
FIG. 3 is an explanatory view of an operation of detecting an abnormality of the dry cleaner of FIG. 1.

To solve the disadvantage, in the present invention, an abnormality detecting operation is performed to detect the abnormal water supplying into the water-cooling heat exchanger 13 and water supply stopping abnormality before starting the cleaning operation by the dry cleaner 1. This abnormality detecting operation, the heat exchanger temperature, and the temperature of the refrigerant before expanding will be described hereinafter with reference to FIG. 3.

In the abnormality detecting operation, the control unit 20 first stops the operation of the compressor 5, and brings the water amount adjusting valve 15 into a fully closed state. Moreover, after an elapse of a predetermined time, the control unit 20 operates the compressor 5, and the water amount adjusting valve 15 maintains its fully closed state. It is to be noted that in this case, the control unit 20 constantly monitors the heat exchanger temperature by the heat exchanger temperature sensor 25.

When the compressor 5 is operated, the high-temperature and high-pressure carbon dioxide refrigerant compressed and brought into the supercritical state in the compressor 5 is discharged from the discharge side of the compressor 5 into the refrigerant discharge tube 17. The refrigerant flows through the electromagnetic valve 8 into the pipe 12 in the form of bypassing of the gas cooler 9. In the process in which the refrigerant passes through the pipe 12, the refrigerant is cooled by the city water pooled in the water-cooling heat exchanger 13, discards the discharged heat, flows into the capillary tube 10 while retaining its supercritical state, and is liquefied in the process in which the pressure is reduced.

In this case, the control unit 20 monitors a change of a cooling water temperature of the water-cooling heat exchanger 13 for a predetermined time after the compressor 5 is operated. The water amount adjusting valve 15 is brought into the fully closed state, and water supply into the water-cooling heat exchanger 13 is stopped. Moreover, since the high-temperature refrigerant discharged from the compressor 5 flows into the pipe 12 disposed in such a manner as to exchange the heat with the water-cooling heat exchanger 13 in the form of the bypassing of the gas cooler 9, the heat exchanger temperature rises. Therefore, in a case where there is a rise of the heat exchanger temperature, for example, a change of 2° C. to 5° C. as a degree capable of confirming the temperature rise for a predetermined time of, for example, 60 to 180 seconds in the normality/abnormality judging means 21, the control unit 20 judges that the water amount adjusting valve 15 normally operates. In a case where any rise of the heat exchanger temperature is not observed for the predetermined time, the control unit judges that there occurs such water supply stopping abnormality that the water amount adjusting valve 15 cannot be brought into the fully closed state.

Moreover, when the normality/abnormality judging means 21 judges that the abnormality is caused, the control unit 20 issues an alarm from the alarming means 22 to inform a user of occurrence of the water supply stopping abnormality.

When any abnormality is not detected in the confirmation of the fully closed operation, next the control unit 20 brings the water amount adjusting valve 15 into a fully open state while maintaining an operated state of the compressor 5. It is to be noted that even in this case, the control unit 20 constantly monitors the heat exchanger temperature by the heat exchanger temperature sensor 25.

Accordingly, when the compressor 5 of the refrigerant circuit 4 is operated, the high-temperature and high-pressure carbon dioxide refrigerant compressed in the compressor 5 and brought into the supercritical state is discharged from the discharge side of the compressor 5 into the refrigerant discharge tube 17, and flows through the electromagnetic valve 8 into the pipe 12 in the form of the bypassing of the gas cooler 9. In the process in which the refrigerant flows through the pipe 12, the refrigerant is cooled by the city water circulated through the water-cooling heat exchanger 13. The refrigerant discards the discharged heat, flows into the capillary tube 10 while retaining its supercritical state, and is liquefied in the process in which the pressure is reduced.

In this case, the control unit 20 monitors a change of the cooling water temperature of the water-cooling heat exchanger 13 for a predetermined time from a time when the water amount adjusting valve 15 is fully opened. Here, since the high-temperature refrigerant discharged from the compressor 5 flows into the pipe 12 in such a manner as to exchange the heat with the water-cooling heat exchanger 13 in the form of the bypassing of the gas cooler 9, the heat exchanger temperature rises. However, since the cooling water controlled in such a manner as to have a maximum passing water amount by the water amount adjusting valve 15 is passed through the water-cooling heat exchanger 13, the temperature of the water-cooling heat exchanger 13, and further the temperature of the refrigerant before expanding in the refrigerant circuit 4 drop by the cooling water.

Therefore, in a case where there is a drop of the heat exchanger temperature, for example, a change of 2° C. to 5° C. as the degree capable of confirming the temperature drop for a predetermined time of, for example, ten seconds to 30 seconds in the normality/abnormality judging means 21, the control unit 20 judges that the water amount adjusting valve 15 normally operates, a sufficiently amount of cooling water is secured, and a disadvantage such as clogging is not caused. On the other hand, in a case where any rise of the heat exchanger temperature is not observed for the predetermined time, the control unit judges that there occurs the water supply stopping abnormality such as clogging of the water amount adjusting valve 15 or the city water pipe 14.

Moreover, when the normality/abnormality judging means 21 judges that the abnormality is caused, the control unit 20 issues the alarm from the alarming means 22 to inform the user of the occurrence of the water supply stopping abnormality in the water amount adjusting valve 15 or the city water pipe 14.

Thereafter, the control unit 20 stops the operation of the compressor 5, fully opens the water amount adjusting valve 15, and ends the abnormality detecting operation.

Consequently, according to the present invention, in the abnormality detecting operation, the water supply stopping abnormality or the water supply abnormality can be detected with respect to the water-cooling heat exchanger 13 without particularly using any water amount gauge. Therefore, it is possible to detect early the generation of scales generated by use of the city water in the city water pipe 14 or the water amount adjusting valve 15. Since the alarming means 22 can inform the water supply stopping abnormality or the water supply abnormality, it is possible to cope with the abnormality quickly.

Moreover, according to the present embodiment, as to the temperature rise and drop in the water-cooling heat exchanger 13, the temperature change is confirmed in such a minimum width as to confirm the change of the temperature, that is, in a range of 2° C. to 5° C. Therefore, an abnormality detecting time can be reduced, and the abnormality detecting operation can be executed substantially without influencing a usual operation mode.

Furthermore, in the present embodiment, the normality/abnormality of the water amount adjusting valve 15 is judged depending on the change of the heat exchanger temperature detected by the heat exchanger temperature sensor 25. However, even when the normality/abnormality of the water amount adjusting valve 15 is judged depending on the changed of the heat exchanger outlet temperature detected by the heat exchanger outlet temperature sensor 26 or the temperature of the refrigerant before expanding detected by the refrigerant temperature sensor 27, a similar effect can be obtained.

Figure 4:
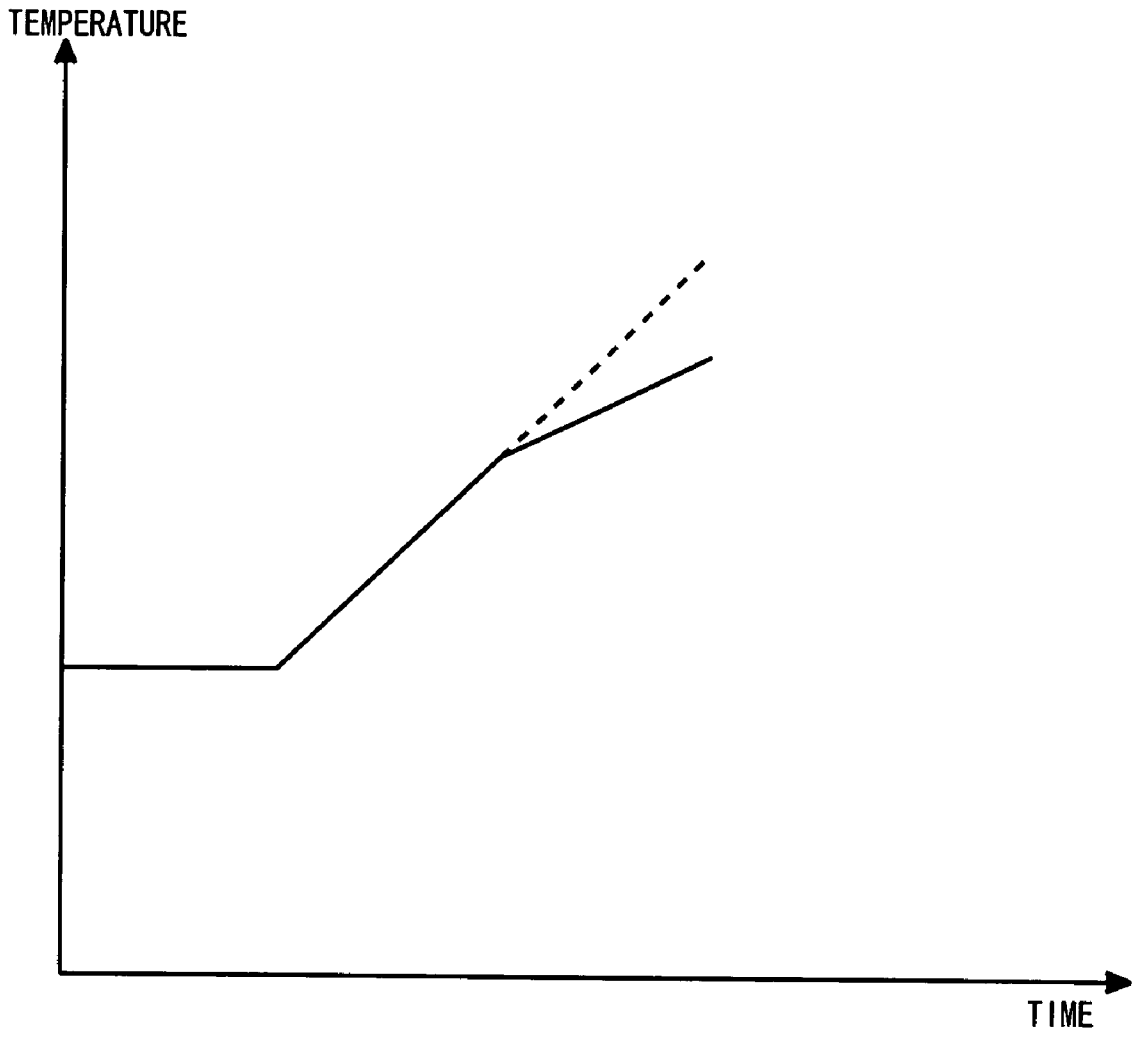
FIG. 4 is a diagram showing an actual temperature change, for example, against memorized temperature change of FIG. 3.
Figure 5:
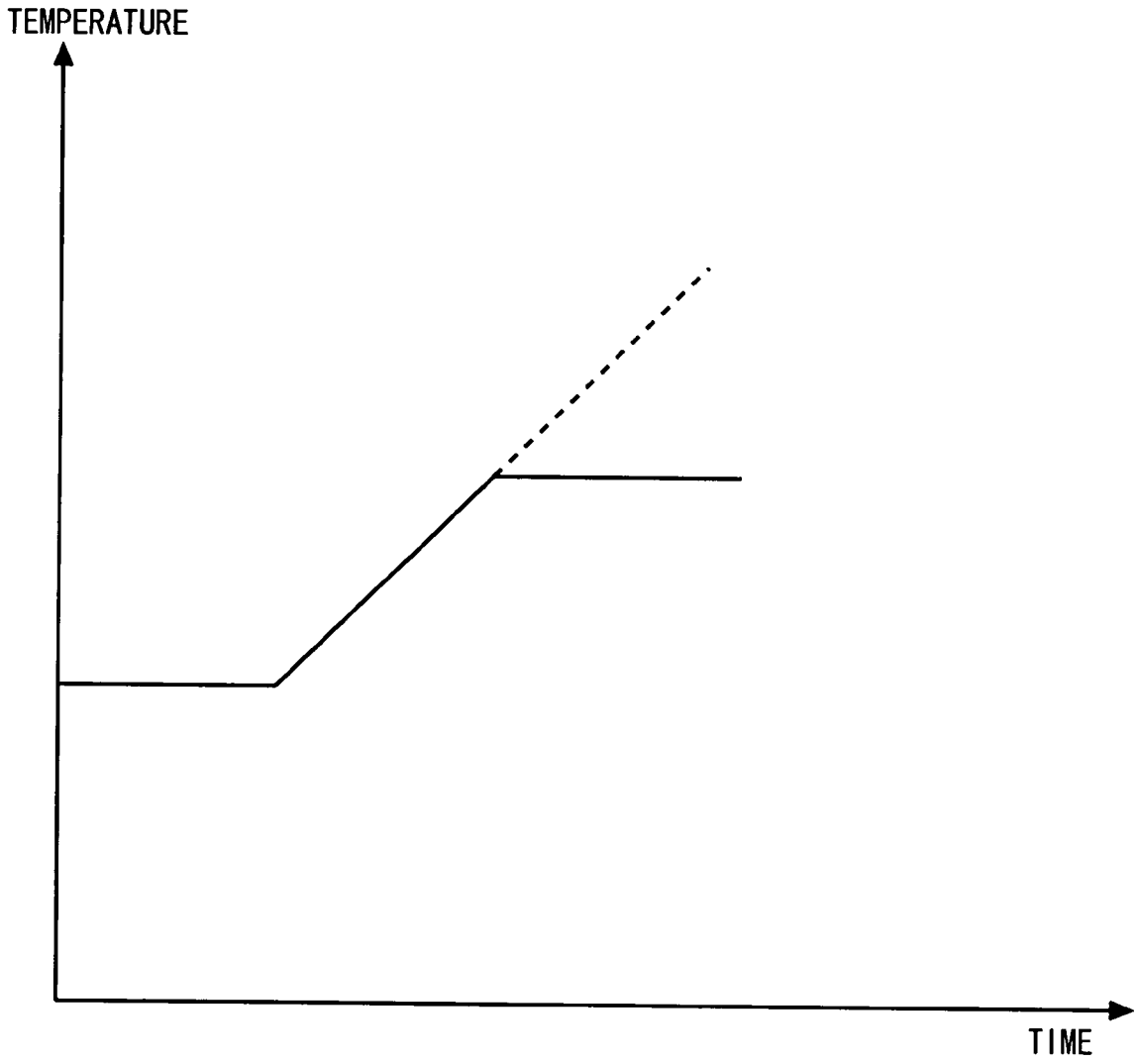
FIG. 5 is a diagram showing an actual temperature change, for example, against memorized temperature change of FIG. 3.

It is to be noted that in the present embodiment, the abnormality detecting operation is performed before the start of the cleaning operation. Additionally, this abnormality detecting operation may be periodically performed, for example, at a time when a certain operation time elapses or a time when the certain number of operation times elapses. It is possible to detect the abnormality even at an actual cleaning and drying operation time. In this case, as shown in FIG. 2, the control unit 20 may store beforehand a temperature change (shown by a broken line) of the water-cooling heat exchanger 13 at a normal time in each operation mode, and compare this data with an actually detected temperature change (shown by a bold line) to detect the water supply stopping abnormality or the water supply abnormality. That is, for example, as shown in FIGS. 4 and 5, in a case where the temperature change of the heat exchanger 13 at the normal time has a tilt shown by a broken line, when the actually detected temperature change of the heat exchanger 13 largely differs from the tilt shown by the broken line, the water supply stopping abnormality or the water supply abnormality is judged. Accordingly, when a slight temperature change is detected in the abnormality detecting operation, the abnormality can be detected in a short time. It is to be noted that in FIG. 2, a solid line shows a change of the water amount in a case where the water amount adjusting valve 15 normally operates.

Additionally, auxiliary heating means is disposed in the water-cooling heat exchanger 13, and the water-cooling heat exchanger 13 is heated by the auxiliary heating means. Consequently, the abnormality detecting operation may be performed only by the controlling of the operating/closing of the water amount adjusting valve 15 without passing the high-temperature and high-pressure refrigerant from the compressor 5 into the pipe 12. Therefore, the abnormality detecting operation can be performed even in a case where the high-temperature and high-pressure refrigerant is not passed from the compressor 5 through the pipe 12 depending on the operation mode.

Consequently, in the present invention, when the above-described abnormality detecting operation is performed, the abnormal water supplying into the water-cooling heat exchanger 13 can be easily detected, and the present invention is especially effective.

Moreover, in the present embodiment, silicon is used as the washing liquid (solvent), but the liquid is not limited to this, and the present invention is effective even in a case where a conventional petroleum-based solvent is used.

It is to be noted that in the present embodiment, the dry cleaner 1 has been described as an example, but the present invention is effective even in a usual selective drying machine or an air conditioner using the heat pump device 3.

Furthermore, in the present embodiment, carbon dioxide is used as the refrigerant in the refrigerant circuit constituting the heat pump device 3, but another refrigerant may be used.

What is claimed is:

1. A heat pump device comprising:

a heat pump comprising a refrigerant circuit;

a water-cooling heat exchanger for taking heat of a refrigerant in the refrigerant circuit;

water amount adjusting valve for adjusting the amount of cooling water supplied into the water-cooling heat exchanger;

temperature detecting means for detecting the temperature of the cooling water in the water-cooling heat exchanger or the temperature of the refrigerant passed through the water-cooling heat exchanger; and control means for controlling the water amount adjusting valve, wherein the control means judges abnormal water supplying into the water-cooling heat exchanger in accordance with the controlling state of the water amount adjusting valve and a change of the temperature detected by the temperature detecting means under the controlling state, wherein during an abnormal water supply detection by the control means, a high-temperature refrigerant flows into the water-cooling heat exchanger by bypassing a gas cooler, such that if the water amount adjusting valve is brought into a closed state by the control means, but no temperature rise is detected in the water-cooling heat exchanger for a predetermined time, the control means determines that the water amount adjustment valve cannot be brought into a fully closed state; and, alternatively, if the water amount adjusting valve is brought into an open state by the control means, but no temperature drop is detected in the water-cooling heat exchanger for a predetermined time, the control means determines that the water amount adjustment valve is abnormal.

2. The heat pump device according to claim 1, wherein the control means performs a predetermined alarming operation in a case where it is judged that the abnormal water supplying into the water-cooling heat exchanger is caused.

3. A drying machine using the heat pump device according to claim 1 or 2, wherein the refrigerant circuit comprises a radiator and an evaporator, and comprising a storage chamber which contains a matter to be dried, wherein air is circulated from the radiator to the evaporator through the storage chamber to thereby dry the matter to be dried in the storage chamber.

* * * * *